United States Patent [19]

Jensen

[11] Patent Number: 4,674,594

[45] Date of Patent: Jun. 23, 1987

[54] SILENCER AND A METHOD OF MANUFACTURING THE SILENCER

[75] Inventor: Leif L. Jensen, Laesten, Denmark

[73] Assignee: Johannes Pedersen, Biborg, Denmark

[21] Appl. No.: 731,404

[22] Filed: May 7, 1985

[30] Foreign Application Priority Data

May 7, 1984 [DK] Denmark ..... 2250/84

[51] Int. Cl.[4] ..... F01N 7/18; B21D 53/00

[52] U.S. Cl. ..... 181/243; 29/157 R; 29/430; 29/463; 29/467; 181/247; 181/282

[58] Field of Search ..... 29/157 R, 430, 467, 29/463; 181/247, 282, 243, 264

[56] References Cited

U.S. PATENT DOCUMENTS

| | | | |
|---|---|---|---|
| 1,353,863 | 9/1920 | Taber | 181/282 |
| 1,688,488 | 10/1928 | Dormeyer | 181/282 |
| 1,741,078 | 12/1929 | Scarritt | 181/282 |
| 1,924,605 | 8/1933 | Haas et al. | 181/247 |
| 2,705,541 | 4/1955 | Finch | 181/243 |
| 3,479,725 | 11/1969 | Shaff et al. | 29/157 R |
| 4,109,752 | 8/1978 | Ferralli | 181/282 X |
| 4,134,472 | 1/1979 | Trainor | 181/243 X |
| 4,184,564 | 1/1980 | Trainor | 181/243 X |
| 4,382,487 | 5/1983 | Baumann | 181/282 |

FOREIGN PATENT DOCUMENTS

| | | | |
|---|---|---|---|
| 704741 | 5/1931 | France | 181/247 |

*Primary Examiner*—Howard N. Goldberg
*Assistant Examiner*—Ronald S. Wallace
*Attorney, Agent, or Firm*—Antonelli, Terry & Wands

[57] ABSTRACT

A silencer comprising a cylindrical casing assembled from two half-cylindrical shell members is produced by placing in one of the shell members a row of modular channel blocks and then completing the silencer by mounting the other shell member over the row of blocks. The modular blocks are selected from a multi store holding groups of blocks of generally uniform outer shapes, but prefabricated with mutually different inner shapes such that the different blocks, each one or each pair thereof, show specific characteristics with respect to the throttling and/or sound damping capacity, whereby effective silencers for different engines are easy and cheap to manufacture, even with the use of non-corroding materials.

9 Claims, 6 Drawing Figures

SILENCER AND A METHOD OF MANUFACTURING THE SILENCER

The present invention relates to a silencer for the exhaust system of combustion engines, primarily for vehicles, and a method of manufacturing the silencer.

In practice it is necessary to produce a wide variety of different silencers, because almost each single engine model shows its own requirements with respect to the combination of throttling and silencing requirements, the latter being conditioned by the specific sound frequency specturm of the motor. Though the design principles may be the same for the different silencers they should nevertheless be produced with particular specifications for each engine model, and at least in specialized silencer factories this amounts to a considerable problem with respect to the required flexibility of the production. Each change-over for the production of a new or another silencer type is costly, and for avoiding too frequent changes it is normally necessary to build up rather large stores of many different types of silencers.

It should be mentioned that a specific silencer type exists, viz. containing a sound absorbing material, normally a fibrous, soft material, which is effectively damping for all relevant sound frequencies, whereby the silencers may to some degree be standardized, though still in groups of different throttling capacities. However, silencers of this type suffer from the general drawback that the sound absorbing material gets decomposed and disappears by and by, often within few months only. The invention, therefore, is primarily related to the other main type of silencers, wherein the damping is effected by arranging for various rigid-walled chamber portions, in which the sound is damped by resonance or reflection effects.

It is the purpose of the invention to provide a silencer of the last mentioned kind which is well suited to be manufactured in a simple manner such that the production can easily be changed over between different types of silencers.

The invention is based on the recognition that at least the vast majority of ordinary car engines may be used with a silencer which is built up with or as a row of relatively few modular silencer elements selected from a higher, but still relatively low number of different modular elements, whereby each of the elements or each pair of juxtaposed elements causes a damping action in some specific frequency range. The elements may be of uniform outer shape and thus be assembled in a standard casing, wherein already a sufficient number of five or six elements selected from only about the double number of different elements will provide for many thousands of possibilities of operatively different silencers.

Thus, what is sufficient for the production of a silencer for a given engine is to bring a standard casing into a mounting position, select a low standard number of elements from a magazine of preshaped elements or rather from a higher, but still a very low number of magazines of preshaped mutually different elements, placing the selected elements in the casing, and closing the casing. In practice, of course, the act of selecting the correct elements for a given engine model may, simply, be an act of reading in the engine model into a computer or control unit which is preprogrammed to effet the relevant correct selection in an automatic manner, and of course even the mounting of the selected elements in a correct order of succession and the closing of the casing may easily be effected automatically.

It will be appreciated, therefore, that from a production point of view it will be practically completely unimportant whether the next single silencer to be produced whould be of the same type as the previous one or of any other type amoung hundreds or thousands of such other types. In an only semi automatic production it will of course be convenient to produce the silencers in series of uniform types, but still the change over from one type to another will be very easy to arrange for.

This easiness, of course, will imply a previous production of the different elements, just as the various parts of conventional silencers should be preproduced before the assembly thereof, but the required elements are quite easy to produce, e.g. by a moulding or pressing technique, and they will be mountable merely by being "shovelled together" in the casing.

It is a very important consequence of the invention that the production costs may be reduced to such a degree that it becomes commercially realistic to make use of highly resistant and relatively expensive materials such as stainless steel for the casing, whereby it is practically possible to overcome the long existing problem of the relatively short lifetime of ordinary silencers.

According to an important modification of the invention as so far described it will be possible to make use of only one type or extremely few types of prefabricated silencer elements, inasfar as it will be possible to subject each prefabricated element to any required individual working in direct connection with its transfer from the element magazine to the silencer casing. In this way a standard element member may be worked, rapidly, so as to adopt a final shape corresponding to any one of the said different elements as otherwise housed in individual magazines, and in this connection the said computer or control unit should control the operation of the working equipment rather than the selection of already prepared, different elements. It will be a matter of skilled choice whether in a particular production it should be preferred to prefabricate but very few element members and use a selectively operable working tool arrangement, or whether it is better to dispense with any individual working and rely solely on a higher number of prefabricated different elements. Even a combination of these two basic possibilities may be considered.

The invention, based upon the above considerations, is more precisely defined in the appended claims, which specify not only the design of the silencer according to the invention, but also the preferred method of producing such silencers in an at least semi automatic manner.

It should be mentioned that it is known in the art to produce a silencer for a given purpose in a ventilation plant by incorporating in a cylindrical casing a number of round disc elements having an eccentric middle hole, see U.S. Pat. No. 3,545,566, whereby the silencer may be finely adjusted to the engine by mounting the disc elements with their eccentric holes in different angular positions, such that the holes will overlap each other to a higher or smaller degree. However, while the throttling capacity is adjustable in this manner the damping characteristic will be adjustable to any significant degree, and the said disc elements, therefore, comprise a sound absorbing material. Basically, therefore, even this known silencer is of the type based on the use of a sound absorbing material, and in the said specification there is no mentioning of a controlled, diversified production of silencers for engines.

In the following the invention is described in more detail with reference to the drawing, in which.

Figure 1:
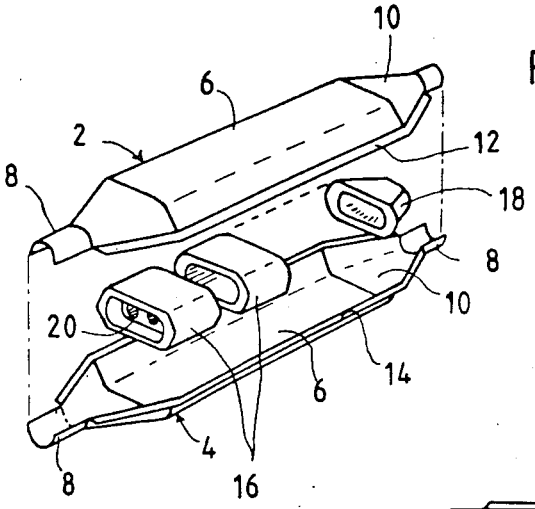
FIG. 1 is a perspective exploded view of a silencer according to the invention.
Figure 2:
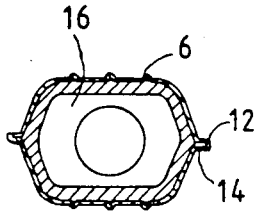
FIG. 2 is a cross sectional view thereof.

The silencer shown in FIG. 1 consists of two outer casing shells 2 and 4 made of a pressed stainless sheet material. These shells are shaped with similar half-cylindrical middle portions 6 of non-circular cross section which are endwise terminated by half tubular connector portions 8 through conical end portions 10. Along their opposite edges the middle portions 6 and the conical end portions 10 are provided with outwardly projecting edge flanges 12 and 14, of which the flanges 14 are broader so as to be foldable about the flanges 12 by a later joining operation. The half tubular connector portions 8 are not provided with corresponding edge flanges, since they are wanted to be joinable so as to form smooth pipe stubs for clamp connection with exterior exhaust pipes.

Before the joining of the two casing shells 2 and 4 a number of modular channel blocks 16 of an outer shape corresponding to the cross sectional shape of the joined shells is placed in the lower shell 4, the blocks filling out the conical end portions 10 being designated 18. The blocks 16 are of uniform length and outer cross sectional shape, and they are all provided with one or more axial holes, but the disposition of these holes and the entire internal design of the various blocks may be individual. Thus, as shown most clearly in FIGS. 1, 3 and 4, the generally tubular blocks may have an interior cross wall 20, which is located individually spaced from the ends of the block, and the various blocks may be different also in other respects, e.g. with respect to the location or size or shape of the hole or holes in the cross walls, while some elements may be simply tubular, without having any interior cross wall at all.

Experiments have shown that with a suitable combination of only some four-six block members 16 selected from a relatively low number of differently shaped block members, e.g. some ten-twelve different block types, an effective silencer can be produced in a standard casing for practically every existing model of combustion engine at least within a wide range as defined by private cars versus trucks and other heavier vehicles. For the latter vehicles, of course, it will be possible to produce silencers of an enlarged standard size.

Figure 3:
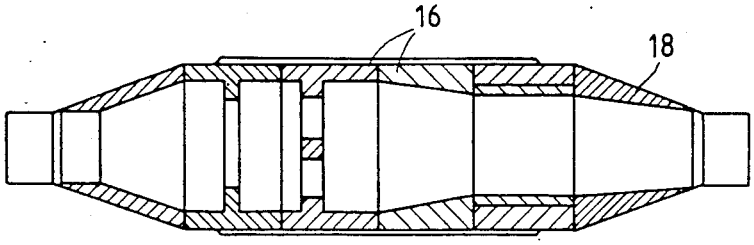
FIG. 3 is a longitudinal sectional view thereof.
Figure 4:
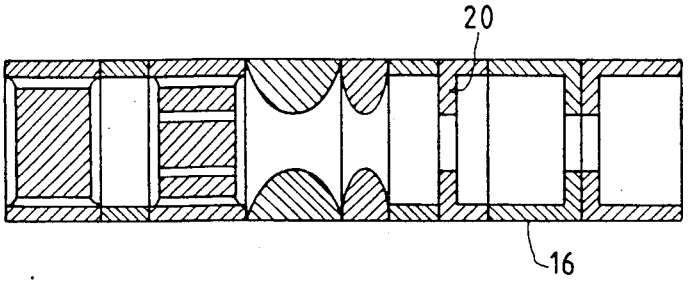
FIG. 4 is a similar view illustrating other configurations of applied insertion elements.

FIGS. 3 and 4 show different examples of the design of the blocks 16. The various detailed designs will not be discussed in more detail, because there are numerous possibilities of providing block members shaped so as to be effectively sound damping either by themselves or by their being combined with other block members, whereby e.g. wide channel portions of different lengths for standing sound waves may be arranged for in the silencer casing. Experiments have shown, however, that only some ten to twelve different block shapes are required for making five or six selected ones operative for many different engine models.

The material of the blocks may be ceramics, preferably a lightweight porous ceramics or a similar heat and acid resistant material. The surfaces may well have sound absorbing qualities, but the use of decomposable materials should be avoided.

The selected blocks including the end blocks 18 will fill out the shell casing, but it will be appreciated that with the particular shape and joining method of the shells it will be easy to compensate for some tolerance deviations both axially and in the cross directions, such that the blocks will be firmly enveloped. The blocks may even be slightly compressible when they are made of a suitable pressed, porous material. It may be preferable to effect the necessary throttling adjustment of the silencers by means of special submodular plate elements having respective channel holes of the various relevant sizes.

Figure 5:
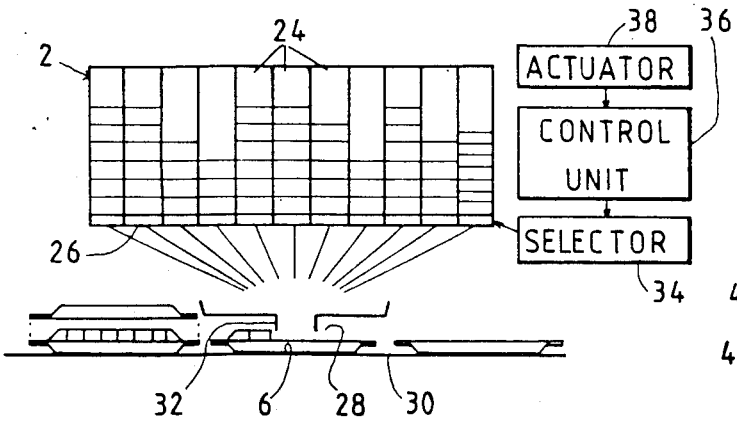
FIG. 5 is a schematic view illustrating one method of manufacturing the silencers.

FIG. 5 illustrates a subdivided store 22 comprising a plurality of magazines 24 for the respective different channel blocks 16 and 18, these blocks being produced as standard units for supply to the respective magazines 24. The store 24 has an outlet bottom 26 operable to consecutively release the lowermost block 16 or 18 in any selected magazine 24, whereby the released block is guided to a mounting station 28, in which a casing shell member 6 is moved stepwise, on a conveyor 30, past a downlet 32 for the blocks as released from any one of the magazines 24. The release devices of the bottom 26 are selectively actuated by a selector unit 34 controlled by a control unit 36, which includes a memory register for the required block combinations of silencers for the various engine models. The control unit has an actuator unit 38, which is operable to inform the control unit 36 of the engine model, for which the next silencer is to be produced.

In this manner the stepwise moved casing shell 6 will receive, successively, the selected blocks 16 and 18 for the build-up of the particular silencer for the required purpose. Obviously, the actuator unit 38 may be set to cause any desired number of identical silencers to be produced consecutively, but the production will be quite as easy even if the consecutively produced silencers are not identical.

Figure 6:
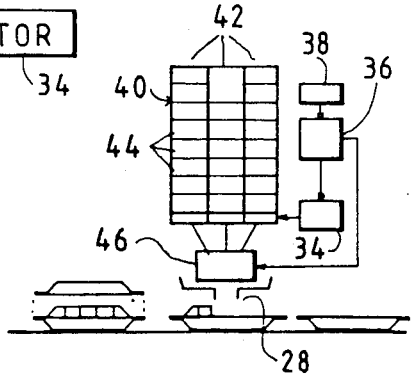
FIG. 6 is a similar view illustrating another manufacturing method.

FIG. 6 illustrates a modified manufacturing method, in which a store 40 is subdivided in only a small number of individual magazines 42 for channel block members 44. These block members are units which are prefabricated with the required main dimensions and design, though without being finished as far as some details are concerned, e.g. the provision of one or more holes in a transverse wall portion thereof. In other words, the block members need a final working operation in order to be ready for use as the said diversified channel blocks, while on the other hand each block member can be converted into any of several possible different channel blocks merely by being worked in any of a variety of possible manners, e.g. with respect to the size and positioning of one or more holes in a wall portion thereof or with respect to removal of material otherwise or even insertion of additional material portions.

For carrying out the required final working of the single block members before these are delivered to the silencer shell 6 there is arranged, above the mounting station 28, a working station 46 including the necessary tool equipment for effecting the working in the required selective manner. The operation of the working station is controlled by the control unit 36 in accordance with the requirements for each single block member of each single silencer, irrespectively of the sound damping effect being conditioned by the respective single blocks or by the pairwise juxtaposition of the blocks.

What is claimed is:

1. A silencer for combustion engines, the silencer comprising a cylindrical casing, a row of modular channel blocks mounted in the cylindrical casing, the modular channel blocks together forming an insert accommodated in the casing adapted to individual throttling and sound damping requirements, characterized in that the modular channel blocks are of mutually different detailed designs with respect to throttling or sound damping abilities thereof, each of the modular channel blocks constituting selected prefabricated or selectively preprocessed units, which, when placed in said row in a standard casing, form said insert, and in that the modular channel blocks are disposed in axial abutting relationship in such a manner that the insert is axially clamped between respective end portions of the casing.

2. A silencer according to claim 1, in which the modular channel blocks are shaped with a non-circular circumference and are mounted in a correspondingly non-circular casing.

3. A silencer according to claim 1, in which the casing is made of two preferably stainless sheet half-cylindrical shell members, which are joined along their edges and have conically narrowing end portions such that in their edge joined condition they exert an axial pressure on the modular channel blocks located in said end portions.

4. A silencer for combustion engines, the silencer comprising a cylindrical casing, a row of modular channel blocks mounted in the cylindrical casing, the modular channel blocks together forming an insert accommodated in the casing adapted to individual throttling and sound damping requirements, characterized in that the modular channel blocks are of mutually different detailed designs with respect to throttling or sound damping abilities thereof, each of the modular channel blocks constituting selected prefabricated or selectively preprocessed units, which, when placed in said row in a standard casing form said insert, and in that at least some of the modular channel blocks are shaped as tubular elements having a transverse wall portion, which is located individually spaced from the respective opposite ends of the element and is provided with one or more channel holes.

5. A method of producing a silencer having predetermined specifications for use in connection with a specific engine model of a motor vehicle, the silencer comprising a cylindrical casing, a row of modular channel blocks mounted in the cylindrical casing, the modular channel blocks together forming an insert accommodated in the casing adapted to individual throttling and sound damping requirements, the modular channel blocks are of a mutually different detail design with respect to throttling or sound damping abilities, each of the modular channel blocks constituting prefabricated or selectively preprocessed units, which, when placed in said row in a standard casing form said insert, the method comprising the steps of supplying to an assembly station a prefabricated standard silencer casing part, building up an insert for said casing part consisting of a generally tubular body by a row of modular channel blocks or segments of individual design, the various modular channel blocks or segments being selectively supplied from a store of externally substantially uniform modular channel blocks or segments in such a manner that the single channel block or segment as supplied to the row of channel blocks or segments show required individual throttling and sound damping characteristics, and joining said casing part with another casing part to form a closed casing about said insert.

6. A method according to claim 5, wherein the modular channel blocks or segments are selected from a multiple group store in which they are present as prefabricated units in a plurality of groups of substantially uniform exterior shape, but with individual interior design.

7. A method according to claim 5, wherein the modular channel blocks or segments are supplied from a store of substantially uniform modular channel blocks or segment members and are successively moved through a working station, in which they are selectively worked to conform with the required individual throttling and sound damping characteristics of the juxtaposed segments before the mounting of the modular channel blocks or segments in the receiving silencer casing part.

8. A method according to claim 5, wherein the channel blocks or segments are placed in a casing constituted by one longitudinal half of a complete silencer casing, the other half of which is mounted over said insert and joined with the edges of the first casing part, the modular channel blocks or segments being sized such that the insert is stabilized axially and radially by the joining of the casing halves.

9. A method according to claim 5, wherein conical segments are mounted in opposite conical ends of the silencer casing.

* * * * *